US007770864B2

(12) United States Patent
Phifer et al.

(10) Patent No.: US 7,770,864 B2
(45) Date of Patent: Aug. 10, 2010

(54) READING STAND

(75) Inventors: Beverly C. Phifer, Tuscaloosa, AL (US); Thomas G. Grammer, Northport, AL (US); Marsha Sprayberry, Tuscaloosa, AL (US); Tanya D. Baker, Northport, AL (US); M. Scott Clark, Tuscaloosa, AL (US)

(73) Assignee: Phifer Incorporated, Tuscaloosa, AL (US)

( * ) Notice: Subject to any disclaimer, the term of this patent is extended or adjusted under 35 U.S.C. 154(b) by 0 days.

(21) Appl. No.: 11/341,463

(22) Filed: Jan. 30, 2006

(65) Prior Publication Data

US 2006/0186303 A1 Aug. 24, 2006

Related U.S. Application Data

(60) Provisional application No. 60/647,460, filed on Jan. 28, 2005.

(51) Int. Cl.
*A47G 1/24* (2006.01)

(52) U.S. Cl. ..... 248/455; 248/453

(58) Field of Classification Search ..... 248/454, 248/455, 456, 447, 457, 460, 462, 453
See application file for complete search history.

(56) References Cited

U.S. PATENT DOCUMENTS

| | | | | |
|---|---|---|---|---|
| 43,575 | A | 7/1864 | Dimon et al. | |
| 352,654 | A | 11/1886 | Morton | |
| 542,809 | A | 7/1895 | Reid | |
| 582,140 | A | 5/1897 | Nolon | |
| 590,175 | A | 9/1897 | Trussell | |
| 793,978 | A | 7/1905 | Beidler | |
| 993,761 | A | 5/1911 | Crane | |
| 1,111,607 | A | 9/1914 | Nyberg | |
| 1,203,659 | A | 11/1916 | Smith | |
| 1,821,060 | A | 9/1931 | Isaacson | |
| 1,876,681 | A | 9/1932 | Irwin | |
| 1,919,835 | A | 7/1933 | Giese | |
| 1,996,191 | A | 4/1935 | Cook | |
| 2,003,746 | A | 6/1935 | Headington | |
| 2,136,701 | A * | 11/1938 | Manierre | 248/445 |

(Continued)

FOREIGN PATENT DOCUMENTS

CN 2174093 Y 8/1994

OTHER PUBLICATIONS

European Search Report mailed Mar. 23, 2006, PCT/US2004005705.

(Continued)

*Primary Examiner*—Ramon O Ramirez
(74) *Attorney, Agent, or Firm*—Hunton & Williams

(57) ABSTRACT

The invention provides a reading stand or document holder to support a document for review by a user. The reading stand may include a base portion including at least one aperture to allow the user to grasp the reading stand, as well as a platform portion for supporting the document. The platform portion is hingedly connected to the base portion. The platform portion includes at least one page holder for retaining the document upon the platform portion. Further, the reading stand includes a prop member. The prop member extends from a backside of the platform portion. The prop member is adapted to engage with the base portion so as to support the platform portion in an angled position.

12 Claims, 13 Drawing Sheets

BACK VIEW PROPPED OPEN

U.S. PATENT DOCUMENTS

| | | | | | |
|---|---|---|---|---|---|
| 2,489,553 | A | | 11/1949 | Wofford | |
| 2,572,731 | A | * | 10/1951 | Keith | 248/457 |
| 2,595,682 | A | * | 5/1952 | Lipa | 248/453 |
| 2,627,694 | A | | 2/1953 | Saecker | |
| 3,381,928 | A | * | 5/1968 | White | 248/455 |
| 3,952,989 | A | | 4/1976 | Bannister Hatcher | |
| 4,014,508 | A | | 3/1977 | Weiss | |
| 4,015,813 | A | | 4/1977 | Graham | |
| 4,043,530 | A | | 8/1977 | May | |
| 4,163,539 | A | | 8/1979 | Awofolu | |
| 4,372,630 | A | | 2/1983 | Fuhri | |
| 4,380,947 | A | | 4/1983 | Nishimoto | |
| D269,188 | S | | 5/1983 | Tisdale | |
| 4,436,271 | A | | 3/1984 | Manso | |
| 4,471,933 | A | | 9/1984 | Nelson | |
| 4,896,252 | A | | 1/1990 | Stewart | |
| 5,232,274 | A | | 8/1993 | Johan et al. | |
| 5,375,806 | A | | 12/1994 | Debus et al. | |
| 5,492,299 | A | * | 2/1996 | Thermos et al. | 248/453 |
| 5,533,642 | A | | 7/1996 | Lafond et al. | |
| D373,600 | S | | 9/1996 | Oimas | |
| 5,577,628 | A | | 11/1996 | O'Neil et al. | |
| 5,607,135 | A | * | 3/1997 | Yamada | 248/456 |
| 5,651,525 | A | | 7/1997 | Yang | |
| 5,765,799 | A | * | 6/1998 | Weber | 248/453 |
| 5,797,578 | A | * | 8/1998 | Graffeo et al. | 248/453 |
| 5,823,500 | A | * | 10/1998 | La Coste | 248/444 |
| 5,855,329 | A | | 1/1999 | Pagano | |
| 5,855,351 | A | | 1/1999 | Cziraky et al. | |
| 5,884,889 | A | | 3/1999 | Crosby | |
| 5,893,546 | A | * | 4/1999 | Renfroe | 248/451 |
| 5,944,209 | A | | 8/1999 | Daoud | |
| 6,038,983 | A | | 3/2000 | Lendl | |
| 6,045,108 | A | | 4/2000 | Cziraky | |
| 6,085,917 | A | | 7/2000 | Odom | |
| 6,109,658 | A | | 8/2000 | Moore | |
| 6,971,622 | B2 | | 12/2005 | Ziegler et al. | |
| 7,172,167 | B2 | * | 2/2007 | Phifer et al. | 248/460 |
| 2002/0044819 | A1 | | 4/2002 | Shamoon | |
| 2003/0029985 | A1 | | 2/2003 | Zeller et al. | |
| 2004/0256534 | A1 | | 12/2004 | Phifer et al. | |
| 2005/0098703 | A1 | * | 5/2005 | Cziraky | 248/460 |
| 2005/0121594 | A1 | * | 6/2005 | Kuo | 248/676 |
| 2006/0108494 | A1 | * | 5/2006 | Lancet | 248/456 |
| 2006/0124822 | A1 | * | 6/2006 | Munda et al. | 248/454 |

OTHER PUBLICATIONS

"You can do it Bindependent We Can Help, Adapt-A-Lap book Holder", Adapt-A-Lap book Holder, 4 pages from www.bindependent.com.

"Bodyguard, Nellie's Exercise Equipment . . . ", 1 page from nellies.com.

"Large and Small Paperbacks Stay . . . ", 1 page from store3.yimg.com.

"Relieve Neck and Back Pain, Improve Your Reading Immediately with Our Adjustable Book Holders", 4 pages from www.proportionalreading.com.

"Atlas™ Ergonomic Book & Copy Holders", 1 page from www.bookandcopyholders.com.

"Book Holders", 1 page from sfpl.lib.ca.us.

"You can do it Bindependent We Can Help, Two-Piece Tilting Table", 2 pages from www.bindependent.com.

International Search Report dated Jan. 25, 2008, PCT/US06/16608 (1 page).

European Search Report dated Mar. 9, 2006, EP 04 71 5625 (2 pages).

International Search Report dated Aug. 29, 2005, PCT/USO4/05705 (1 page).

International Search Report dated Aug. 9, 2007, PCT/US06/03005 (1 page).

"MyPlace Pro Workstation," www.asseenontv.com/prod-pages/m_pic_ontv.html, date unknown (1 page).

"Porta-Book," www.portabooktv.com/Default.asp?bhcp=1, date unknown (2 pages).

* cited by examiner

READING STAND

RELATED APPLICATIONS

This application claims priority to U.S. provisional application Ser. No. 60/647,460, filed Jan. 28, 2005, which is incorporated herein by reference in its entirety.

BACKGROUND OF THE INVENTION

The invention relates to devices to support a book or other reading material item.

Various devices have been used in the past to support a book, or other reading material item, such that the particular item may be easily supported and in a position to easily view the contents of the item. However, known devices for supporting a reading material item have various deficiencies.

Some known devices are difficult to hold for extended periods of time, as is often desired when reading. Further, while other devices may be easy to hold in general, they do not support the reading material in such a manner so that it is easy to turn the pages of the reading material.

These and other problems exist with known devices.

SUMMARY OF THE INVENTION

The invention provides a reading stand or document holder to support a document for review by a user. The reading stand may include a base portion including at least one aperture to allow the user to grasp the reading stand, as well as a platform portion for supporting the document. The platform portion is hingedly connected to the base portion. The platform portion includes at least one page holder for retaining the document upon the platform portion. Further, the reading stand includes a prop member. The prop member extends from a backside of the platform portion. The prop member is adapted to engage with the base portion so as to support the platform portion in an angled position.

BRIEF DESCRIPTION OF THE DRAWINGS

The present invention can be more fully understood by reading the following detailed description together with the accompanying drawings, in which like reference indicators are used to designate like elements, and in which.

DETAILED DESCRIPTION OF THE INVENTION

Hereinafter, aspects of the invention in accordance with various embodiments will be described. As used herein, any term in the singular may be interpreted to be in the plural, and alternatively, any term in the plural may be interpreted to be in the singular.

The inventive device, which might be characterized as a reading stand or document holder, for example, may be used to hold books, or other reading items, so that the particular item may be read or in some manner viewed without holding it in the reader's hands, in accordance with one aspect of the invention. In accordance with one embodiment of the invention as described below, an arrangement is provided with a platform portion, along with clamps or arms, that hold the opposite pages of a book, for example, open in a fashion so that the book can be read without physically holding the pages of the book. The platform portion is mounted on a base. The base may be provided with apertures in which a user might extend their fingers so as to hold the base. Hereinafter, further details of the invention will be described.

Figure 1:
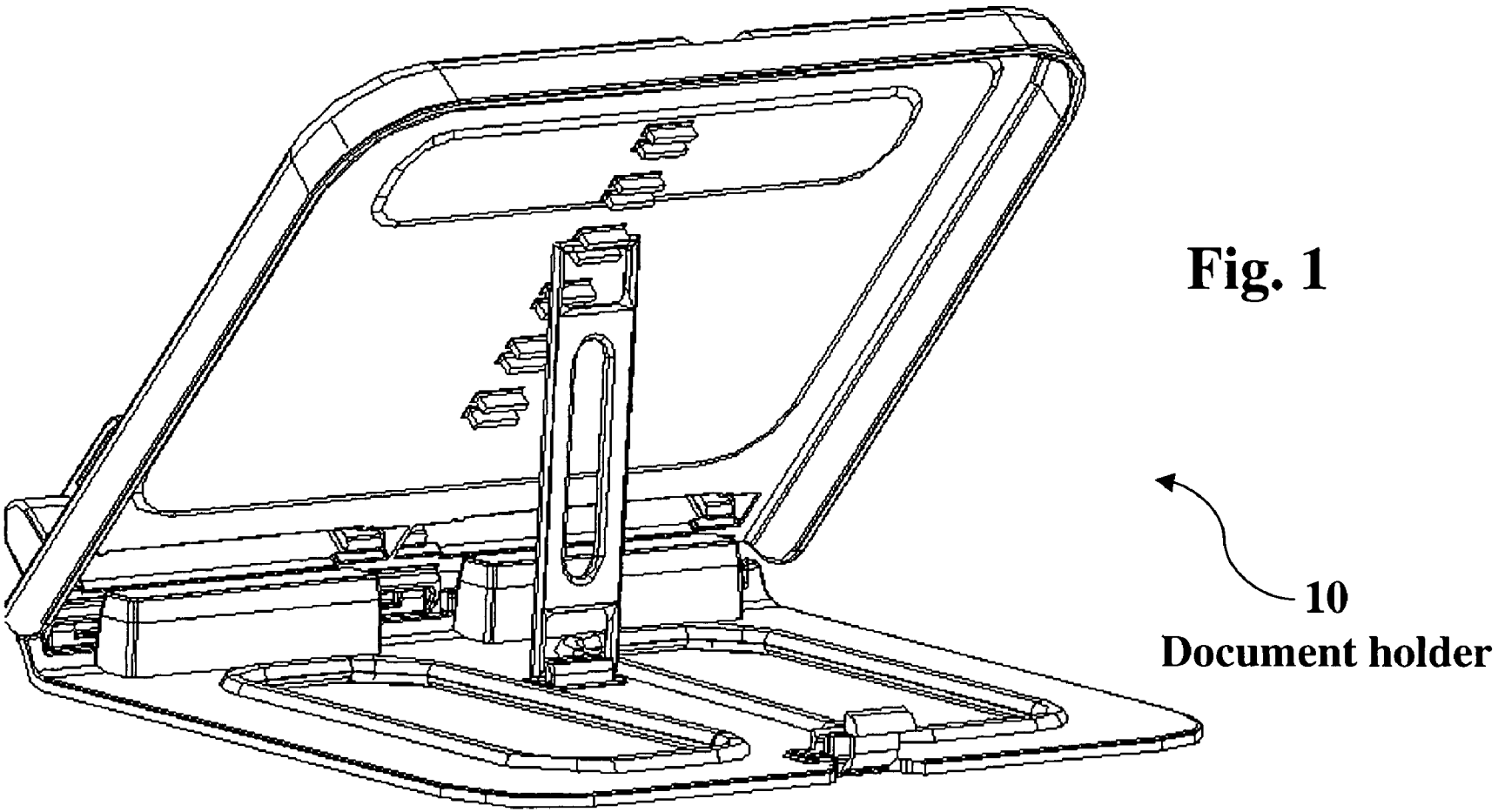
FIG. 1 is a perspective view of a reading stand for supporting a book in accordance with one embodiment of the invention.

FIG. 1 is a diagram showing a document holder 10 in accordance with one embodiment of the invention. As shown, the document holder 10 is shown in the open position.

Figure 2:
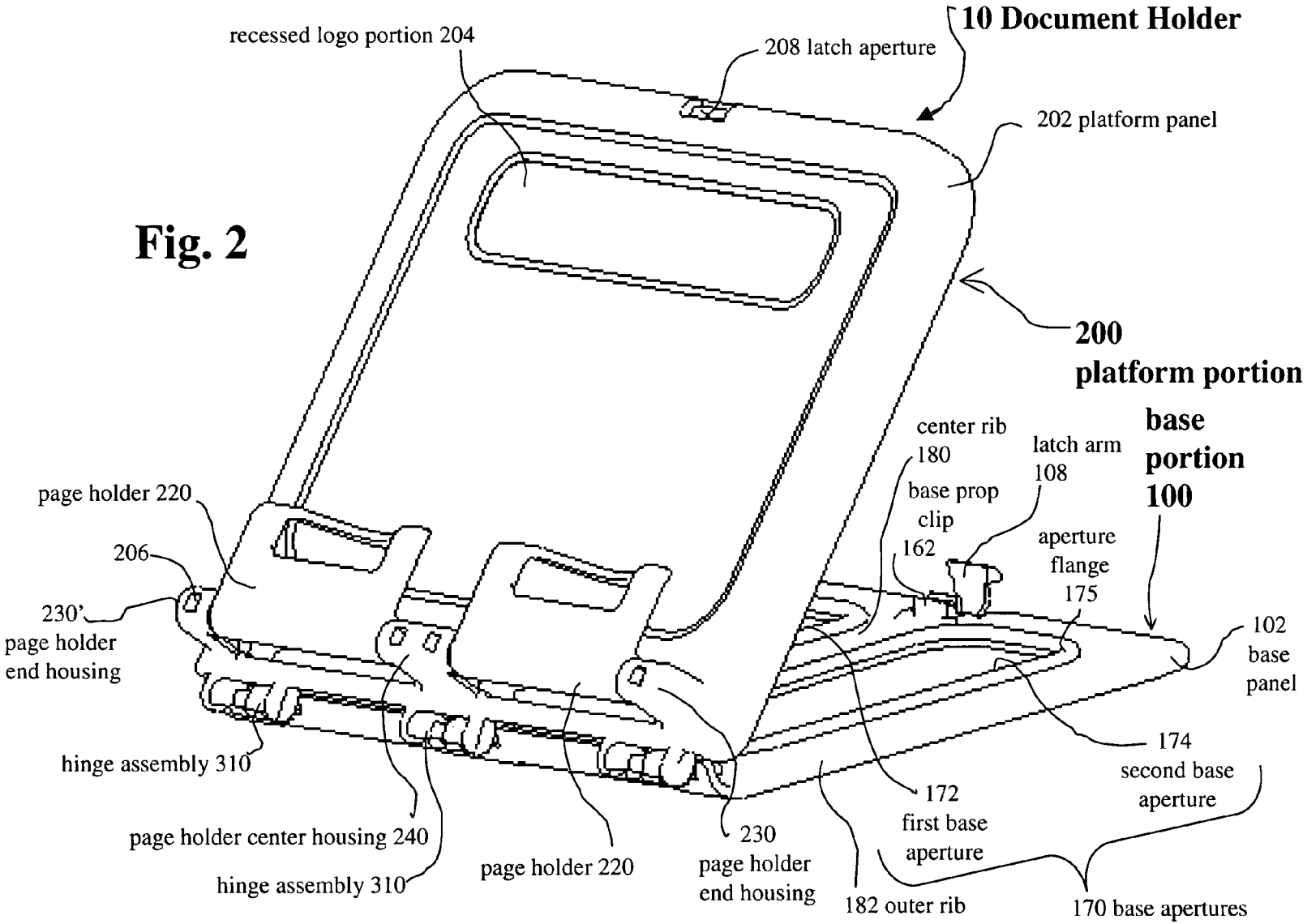
FIG. 2 is a further perspective view showing a document holder in accordance with one embodiment of the invention.

FIG. 2 is a further diagram of the document holder 10. The document holder 10 includes a base portion 100. The base portion 100 is hingedly connected to a platform portion 200. As shown in FIG. 2, a hinge assembly 310 may be used to connect the base portion 100 to the platform portion 200. Further details of the hinge assembly 310 are described below. The base portion 100 may be physically disposed upon a flat surface, for example, or held in any suitable manner. For example, the base 100 might be held and disposed on a user's lap.

Figure 3:
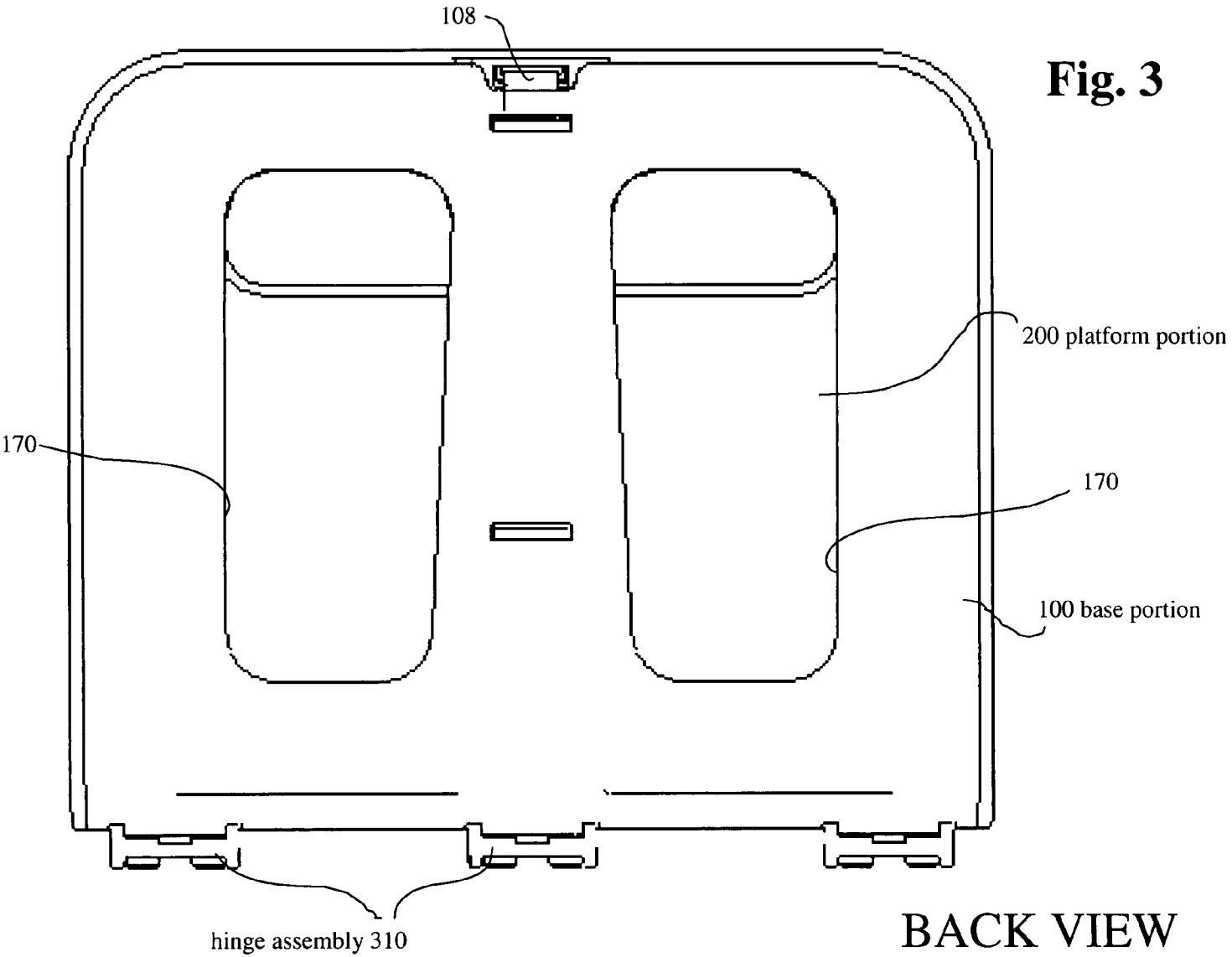
FIG. 3 is a diagram showing a back view of a document holder, i.e., from a bottom view, in accordance with one embodiment of the invention.

In accordance with one novel aspect of the invention, the base portion 100 includes base apertures 170. That is, the base apertures 170 include a first base aperture 172 and a second base aperture 174, as shown in FIG. 2 and FIG. 3. As shown in FIG. 2, the base apertures are separated (and in part defined by) a center rib 180. Further, an outer rib 182 (on each side) serves to define the base apertures 170. The base apertures may extend side by side and along a depth dimension of the base portion, with the two apertures extending along at least two thirds of the depth dimension of the base portion. Each aperture may respectively occupy a substantial portion of half the base portion, with one of the apertures disposed on a right side of the reading stand, and one of the apertures disposed on a left side of the reading stand. As shown in FIG. 2, the base portion may include two annular aperture flanges, each of the two apertures (172, 174) defined by and encircled by a respective one of the annular aperture flanges. The base apertures 170 provide a novel arrangement by which a user might grasp the document holder 10, so as to support a book. For example, the user might hold the document holder 10 by wrapping her fingers around the center rib 180, i.e., such that the user's fingers extend through the base apertures 170. However, it is of course appreciated that any of a wide variety of handgrips might be used so as to support the base portion 100 (and connected platform portion 200). Relatedly, the manner in which a user might position their fingers vis-à-vis the base apertures 170 may of course be widely varied as desired. For example, the user might hold the base portion 100 with bath hands while reading. In this position, the user might wrap her hands around the outer rib 182, on each respective side of the base portion 100.

As noted above, the platform portion 200 is connected to the base portion 100 using hinges 310. Accordingly, the platform portion 200 may be opened and closed as desired. The platform portion 200 may be secured in the closed position in any suitable manner. For example, as shown in FIG. 2, a latch arm 108 is disposed upon the base portion 100. Further, a latch aperture 208 is disposed in the platform portion 200. The latch arm 108 snaps into a latch aperture 208 so as to retain the document holder 10 in a closed position. FIG. 3 is a diagram showing the document holder 10 in an upright closed position, i.e., with the latch arm 108 engaged with the latch aperture 208. However, in lieu of the latch arrangement (108, 208), it is appreciated that other arrangements may be used to secure the base portion 100 to the platform portion 200 in the closed position.

Figure 4:
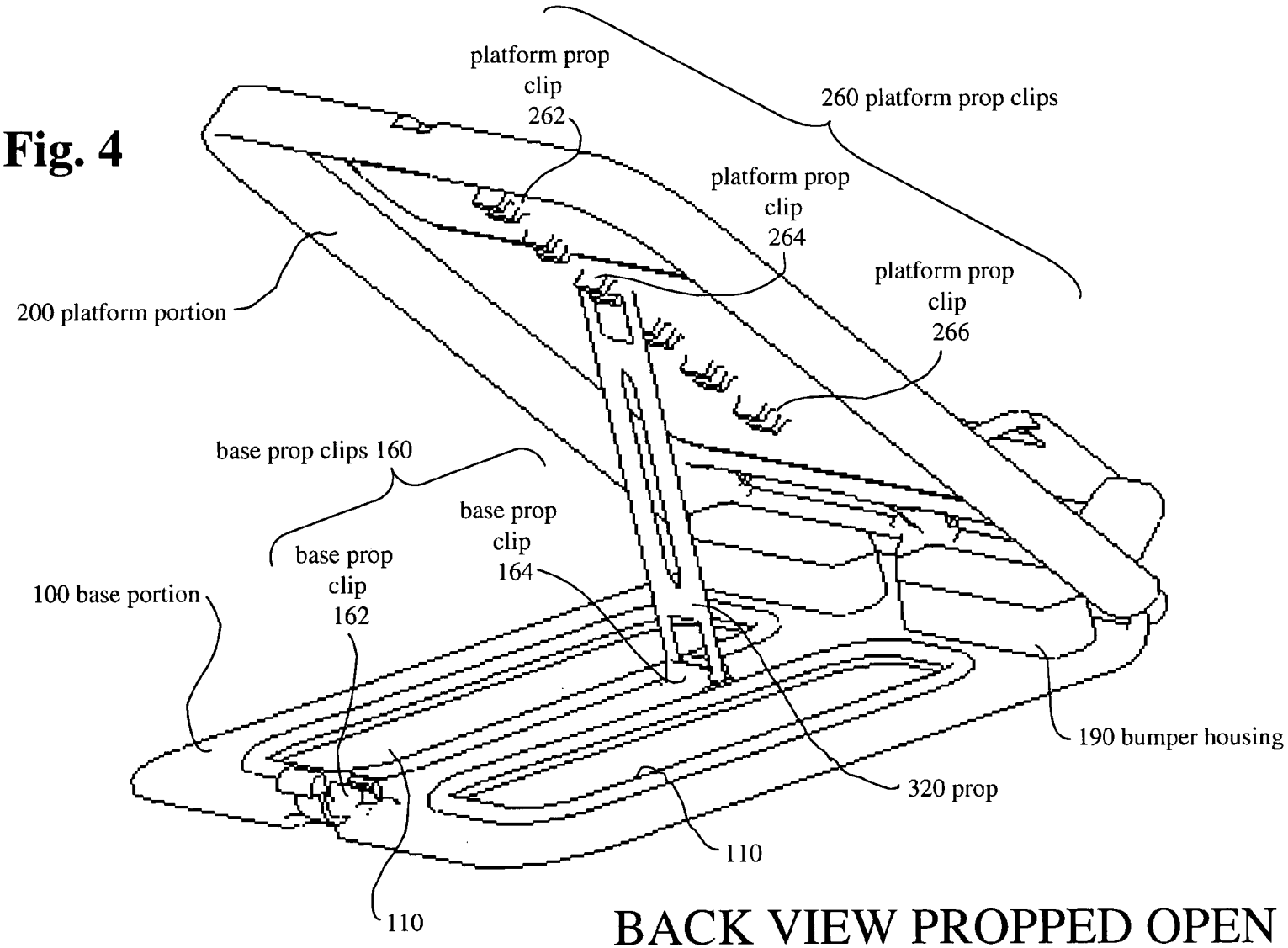
FIG. 4 is a diagram showing a back view of a document holder in the propped open position in accordance with one embodiment of the invention.

FIG. 4 is a diagram showing a back view of a document holder, in the open position, in accordance with one embodiment of the invention. In particular, FIG. 4 shows aspects of a prop arrangement used to support the platform portion 200 relative to the base portion 100. The prop arrangement includes a prop member 320. The respective ends of the prop member 320 are connected to the base portion 100 and the platform portion 200. That is, in accordance with one embodiment of the invention, the platform portion 200 includes a plurality of platform prop clips 260. The platform prop clips 260 include platform prop clip 262, platform prop clip 264 and platform prop clip 266, as well as other platform clips, as may be desired. Each of the platform prop clips 260 may removably retain an upper end of the prop member 320.

Further, the base portion 100 provides for securement of a lower end of the prop member 320. That is, the base portion 100 includes a base prop clip 164. The prop member 320 is pivotally supported in the base prop clip 164. The prop member 320 is not removed from the base prop clip 164 during normal operation of the document holder 10, in accordance with one embodiment of the invention. Accordingly, the prop member 320 is pivotally connected to the base prop clip 164 such that the prop member 320 may be positioned in any of the platform prop clips 260. The angle of the platform portion 200 vis-à-vis the base portion 100 is thus controlled by the particular platform prop clip 260 in which the prop member 320 is connected.

As shown in FIG. 4, the base portion 100 also includes a closed base prop clip 162. The prop member 320 may be disconnected from the platform portion 200 and rotated down so that one end of the prop member 320 clips into the closed base prop clip 162. In this manner, the prop member 320 may be secured for closing of the document holder 10.

Figure 5:
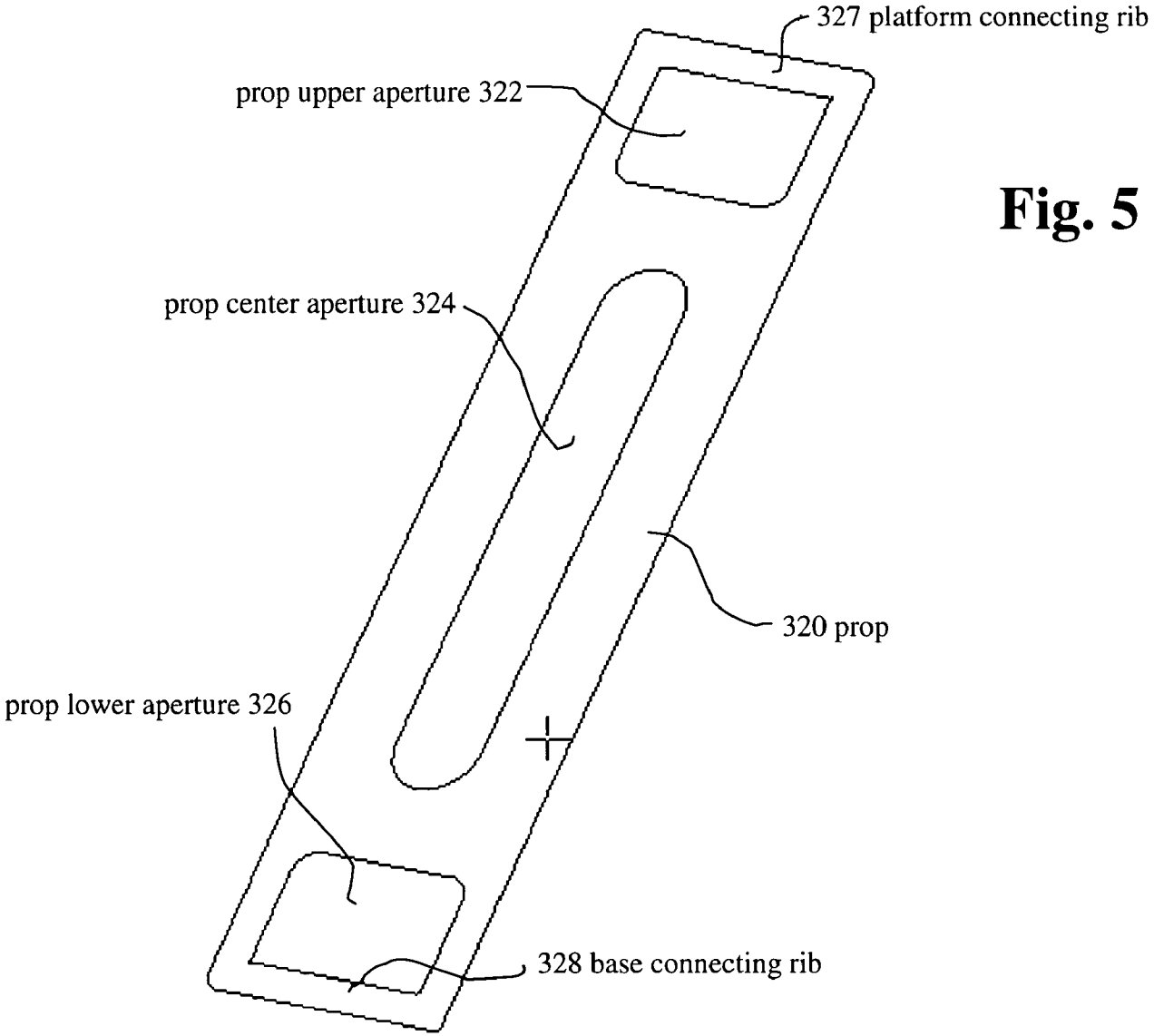
FIG. 5 is a diagram showing a prop member in accordance with one embodiment of the invention.

FIG. 5 is a diagram showing further details of the prop member 320 in accordance with one embodiment of the invention. As shown, the prop member 320 may be in the form of an elongated planer member. The prop member 320 in particular includes a platform connecting rib 327 and a base connecting rib 328. The platform connecting rib 327 serves to connect the prop member 320 to the platform portion 200, and in particular to one of the platform prop clips 260. On the other hand, the base connecting rib 328 serves to connect the prop member 320 to the base portion 100, and in particular to the base prop clip 164. The platform connecting rib 327 is also engageable with the closed base prop clip 162 such that the prop member 320 may be secured when the document holder 10 is closed, as discussed above.

The structure of the prop member 320 provides structural support so as to support the platform portion 200 above the base portion 100 in a variety of angles, as desired. In accordance with one embodiment of the invention as shown in FIG. 5, the prop member 320 further includes a prop upper aperture 322 and a prop lower aperture 326, as well as a prop center aperture 324.

It is appreciated that the described arrangement of the ribs (on the prop 320) and the clips (on the base portion 100 and the platform portion 200) could be reversed. That is, the prop member 320 might be provided with clips, while the base portion 100 and platform portion 200 are both provided with the ribs. In other words, the platform connecting rib and the prop clip components could be reversed, i.e., such that the base portion 100 and platform portion 200 are provided with platform connecting ribs (instead of the prop clips) and the prop is provided with prop clips on both ends (instead of the connecting ribs (327, 328)). In general, it is appreciated that particular arrangements of components as described herein may be reversed. Yet further for example, the platform portion 200 might be provided with the single base prop clip 164 (along with the closed base prop clip 162), while the base portion 100 is provided with the multiple prop clips 260. With such arrangement, the prop would be moved from prop clip to prop clip on the base portion 100 (so as to adjust the angle of the platform portion 200 vis-à-vis the base portion 100).

With further reference to FIG. 4 and FIG. 5, a user may selectively position the platform connecting rib 327 (of the prop member 320) in any of the platform prop clips 260. By varying the particular platform prop clip 260 that the platform connecting rib 327 is disposed in, the user may vary the angle at which the platform portion 200 is supported upon the base portion 100. Once the user decides that she wishes to close the document holder 10, the user snaps the platform connecting rib 327 out of the platform prop clip 264 (for example as shown in FIG. 4) and pivots that prop member 320 so that the platform connecting rib 327 snaps into the closed base prop clip 162. Thereafter, the platform portion 200 may be pivotally lowered into the closed position. Upon closing, the latch arm 108 will snap into the latch aperture 208 so as to secure the document holder 10 in the closed position.

Figure 12:
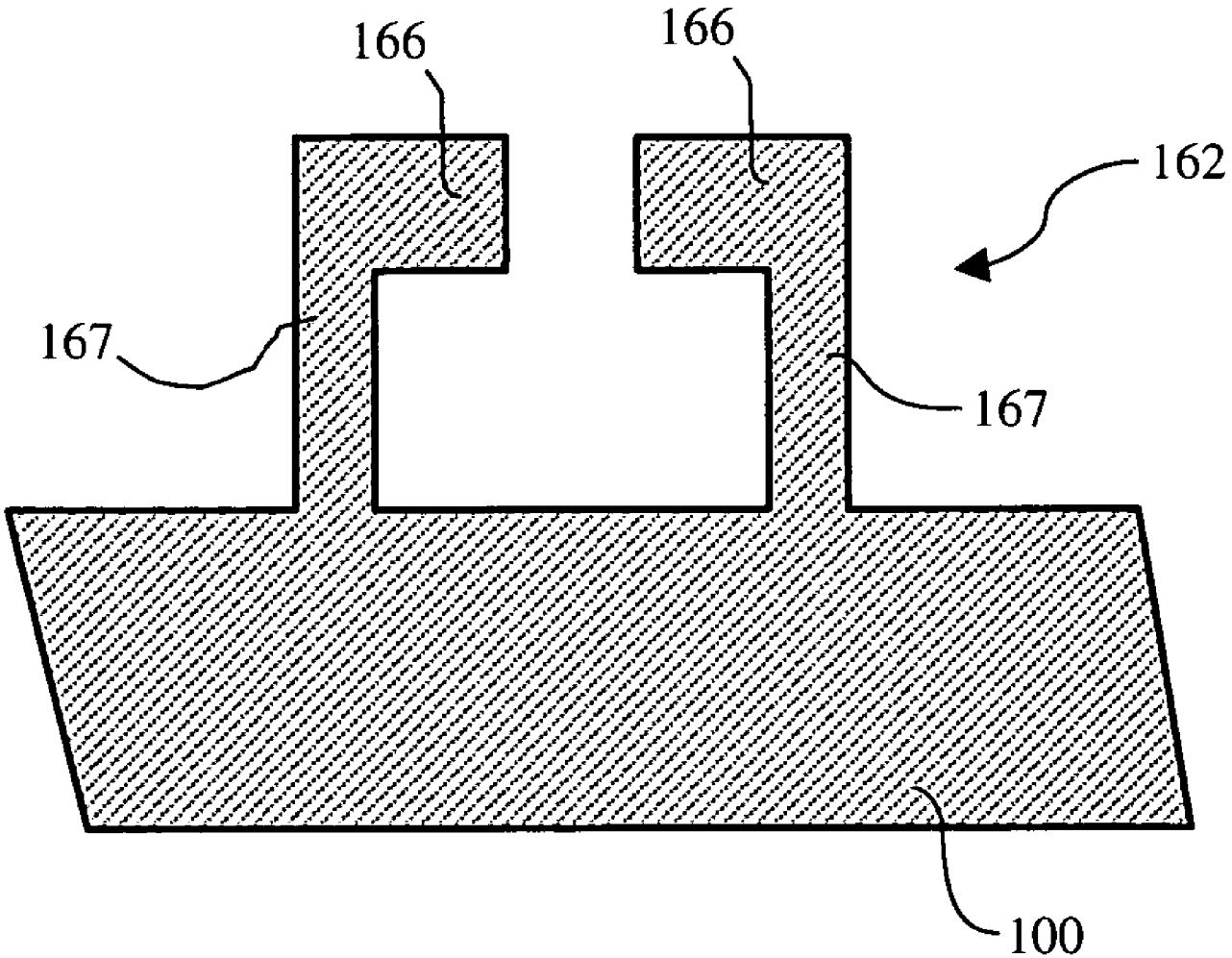
FIG. 12 is a cross-sectional diagram showing details of the clip for retaining a prop member in accordance with one embodiment of the invention.

As shown, the platform prop clips 260 and the base prop clips 160 (162, 164) may be suitably constructed so as to removably retain the prop connecting ribs (327, 328) of the prop member 320. For example, the prop clips (160, 260) may be constructed of two plastic tabs (with retaining ridges) that flexibly spread apart so as to retain the ribs (327, 328) of the prop member 320. Such structure is shown in FIG. 12, in accordance with one embodiment of the invention. As shown in FIG. 12, the base prop clip 162 may be constructed of two planer portions 167, i.e., a web of sorts, along with a shoulder 166 extending along a top edge of each planer portion. Accordingly, the shoulders 166 removably secure the end of the prop. That is, the prop may be removed from the closed base prop clip 162, but with some minor force exerted by the user, i.e., resulting in a slight deformation (bending) of the planer portions 167. In general, the base prop clips 160 and the platform prop clips 260 may have similar structure to the closed base prop clip 162, i.e., such that all the clips (160, 260) are constructed in the same manner. It is also noted, the shoulder 166 may be in any suitable shape (disposed on the planer portion 167) so as to form a protuberance or bump, for example, or any other structure that will serve to retain a rib of the prop member 320, i.e., such that the rib may be forced past the shoulder(s) 166 in adjustment of the document holder 10. Further, only a single shoulder 166 might be used on one planer portion 167 (with the other planer portion 167 not having a shoulder), or a respective shoulder 166 might be used on both planer portions 167.

Figure 10:
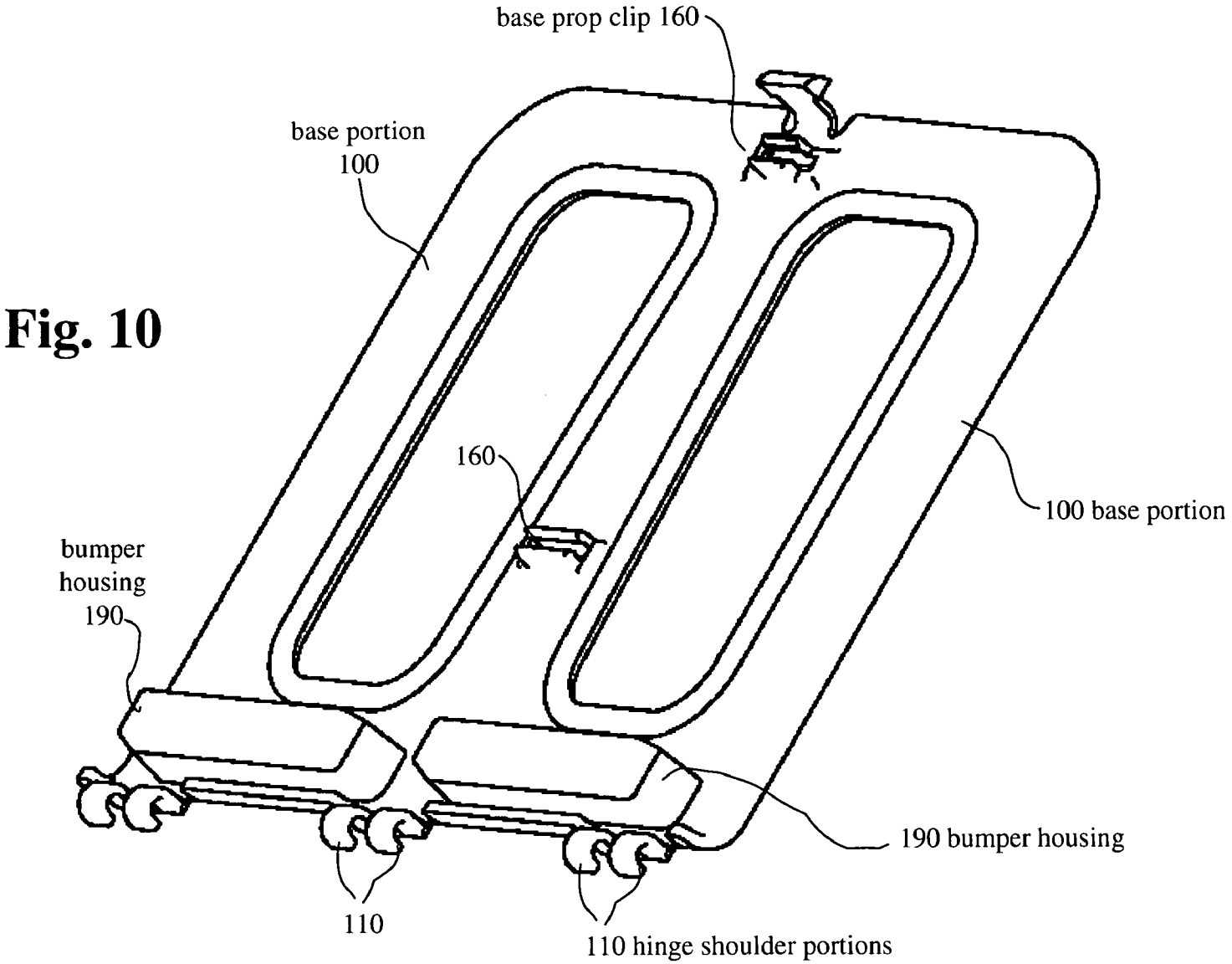
FIG. 10 is a view showing the base portion without the platform portion in accordance with one embodiment of the invention.

As described herein, the platform portion 200 is disposed upon the base portion 100. In accordance with one aspect and arrangement of the invention, the platform portion 200 is supported at a desired angle using the prop member 320. In this arrangement, the platform portion 200 is pivotally disposed upon the base portion 100 using a hinge assembly 310, as shown in FIGS. 2 and 10, for example. In accordance with one embodiment, the hinge assembly 310 includes a hinge shoulder portion 110 that is attached to the base portion 100. The hinge shoulder portion 110 may be integrally formed with the base portion 100. Each hinge shoulder portion 110 may include a set of curved fingers as shown in FIGS. 2 and 10, for example.

Figure 13:
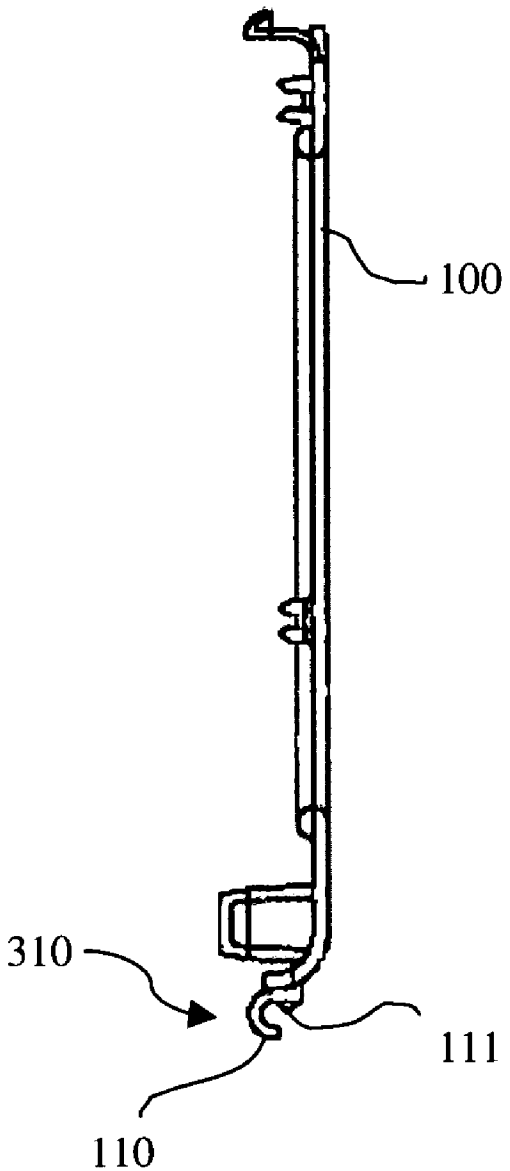
FIG. 13 is a diagram showing a base portion and features of an integral hinge portion accordance with one embodiment of the invention.

Further illustrative of the hinge assembly 310, FIG. 13 shows a hinge shoulder portion 110. The hinge assembly 310 also includes a hinge tab 111, which may be in the form of a bump, ridge or some other type of protuberance. The hinge tab 111 may also be integrally formed with the base portion 100.

Figure 9:
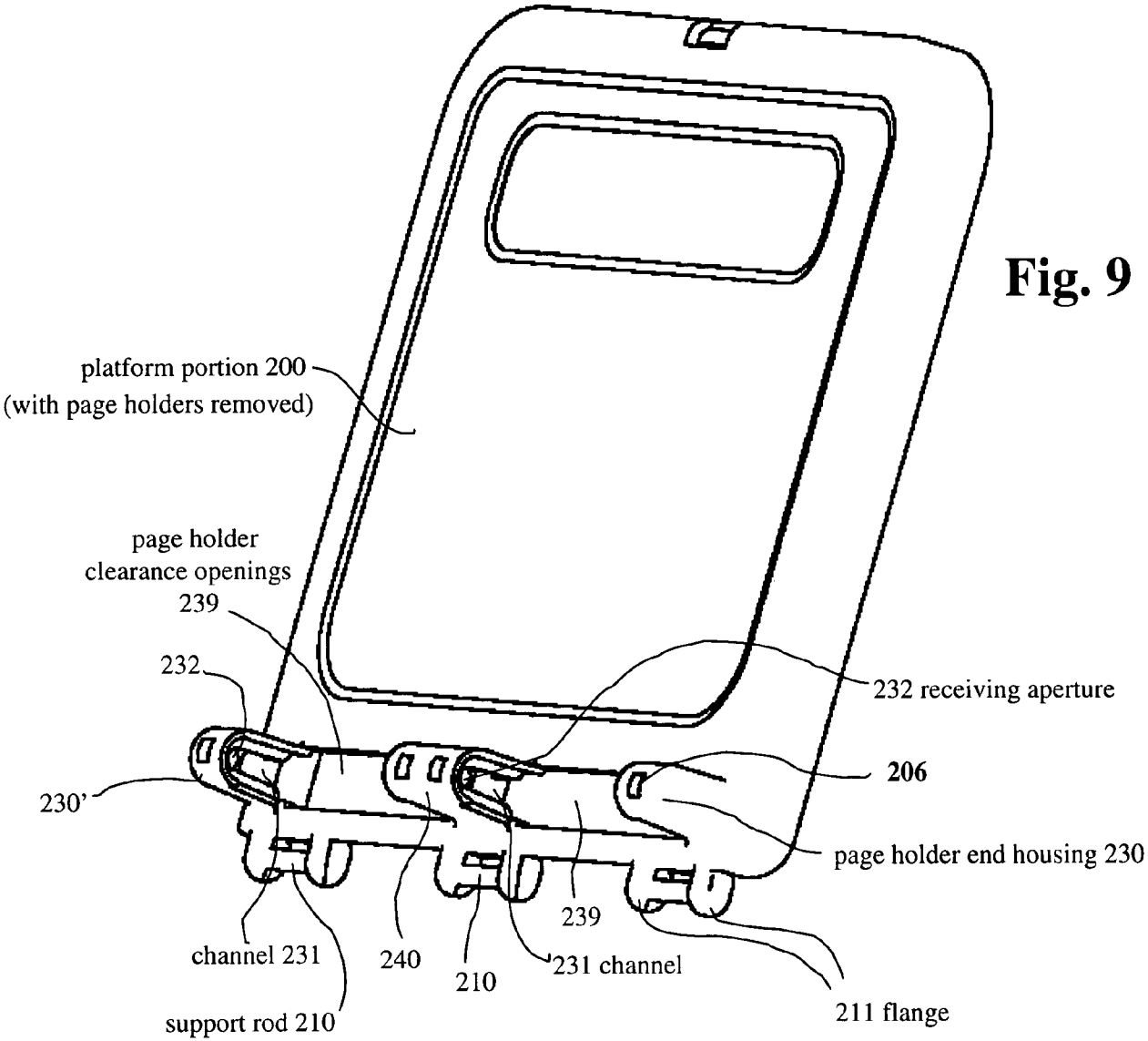
FIG. 9 is a further view showing the platform portion without the base portion and without the page holders in accordance with one embodiment of the invention.

The hinge shoulder portion 110 interfaces with a support rod 210 that is integrally formed with the platform portion 200. The support rod 210 is shown in FIG. 9, for example. That is, the hinge shoulder portion 110 interfaces with the rod 210 so as to provide the hinge 310. The rod 210 is attached to the platform portion 200 between a flange pair 211, as shown in FIG. 9.

In assembly of the document holder 10, the support rod 210 (of the platform portion 200) is positioned into the curve of the hinge shoulder portion 110. As the support rod 210 is slid into the hinge shoulder portion 110, the support rod 210 is pushed past the hinge tab 111 (see FIG. 13) so as to snap into place, typically with some deformation of the hinge shoulder portion 110. As a result, the support rod 210 is retained within the hinge shoulder portion 110.

Figure 11:
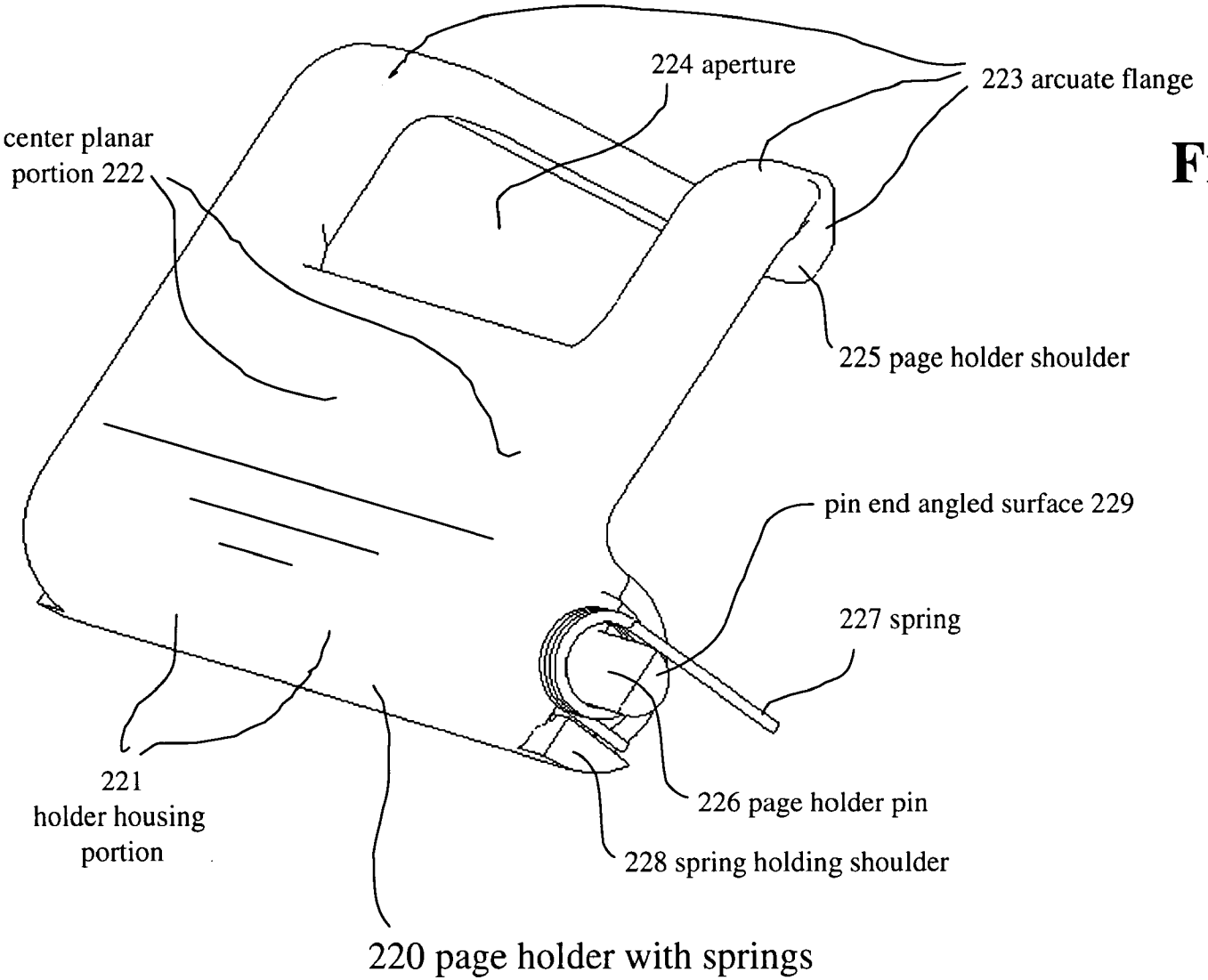
FIG. 11 is a diagram showing a page holder in accordance with one embodiment of the invention.

The structure of page holder 220 will hereinafter be described in further detail. As shown in FIG. 2, the document holder 10 includes the platform portion 200 pivotally disposed upon and connected to the base portion 100, as described above. The page holder 220, or set of page holders, are biased against the platform portion 200 for retaining a document, i.e., such as a book, or any other item for reading or viewing. With reference to FIG. 11, the page holder 220, in accordance with one embodiment of the invention, includes a holder housing portion 221 extending along a first side of the page holder 220, a center planar portion 222 extending along the holder housing portion 221, and an arcuate flange 223 extending along the center planar portion 222. An aperture 224 is defined by the arcuate flange 223 and the center planar portion 222. The page holder 220 may further be characterized as including a page holder shoulder 225 at the end of the arcuate flange 223. The page holder shoulder 225 is what typically makes physical contact with the book or other document while reading.

As shown in FIG. 11, the holder housing portion 221 may be tubular in shape. Further, as shown in FIG. 2, for example, a respective page holder may be supported on the platform portion 200 on respective sides of the platform portion 200. The page holders 220 may be supported by respective housings (230, 230', 240) formed upon the platform portion 200. The housings may be integrally formed with and extend from the platform portion 200. Also, the holder housings (230, 230', 240) for the page holder 220 may be provided so as to form a continuous surface with the holder housing portion 221.

The page holder 220, as shown in FIG. 11, includes a page holder pin 226 extending from each opposite side of the holder housing portion 221 of the page holder 220. The page holder pins 226 extend into the housings (230, 230', 240), as shown in FIGS. 2 and 11. As shown in FIG. 11, the page holder 220 includes a spring 227. The spring 227 biases the page holder 220, and specifically the page holder shoulder 225, against the documents being retained on the platform portion 200. The spring 227, in accordance with one embodiment of the invention, encircles the page holder pin 226. One end of the spring 227 is supported by the spring holding shoulder 228, as shown in FIG. 11. The other end of the spring is supported in the page holder end housing 230, for example, i.e., in the situation where the page holder 220 is supported by the page holder end housing 230 and the page holder center housing 240.

The page holder pin 226 may be respectively received into the housings (230', 230, 240) in any suitable manner. For example, the page holder pins 226 might be each provided with a pin end angled surface 229, as shown in FIG. 11. The pin end angled surface 229 may be provided to allow the pin to slip past a surface in the housings (230', 230, 240) so as to snap into place. That is, as shown in FIG. 9, the page holder pin 226 (at each side of the page holder 220) may be slid into channel 231 and then snapped into a receiving aperture 232 in some suitable manner.

Figure 6:
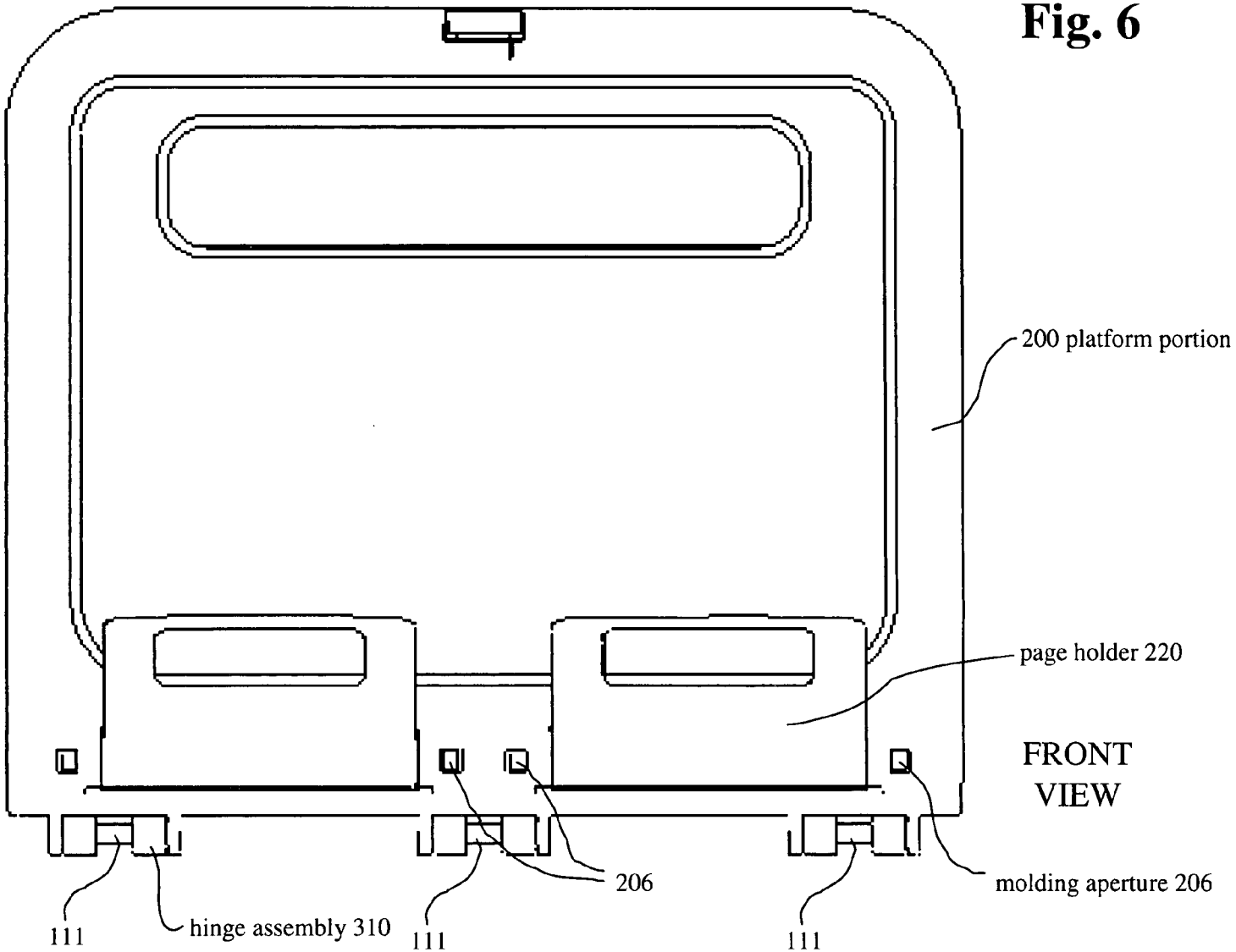
FIG. 6 is a diagram showing a front view of a document holder in accordance with one embodiment of the invention.
Figure 7:
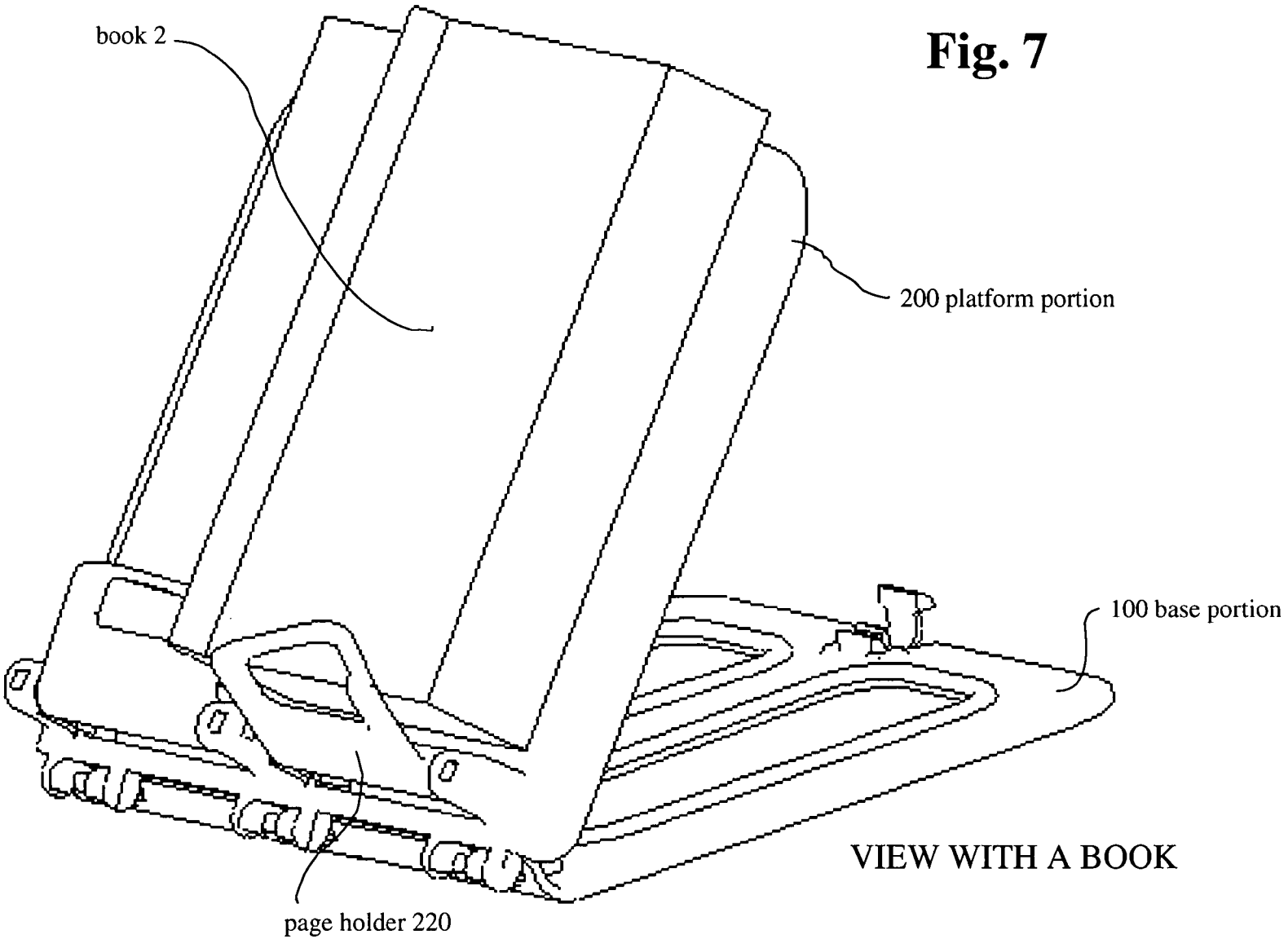
FIG. 7 is a diagram showing a perspective view of a document holder with a book disposed on the document holder in accordance with one embodiment of the invention.
Figure 8:
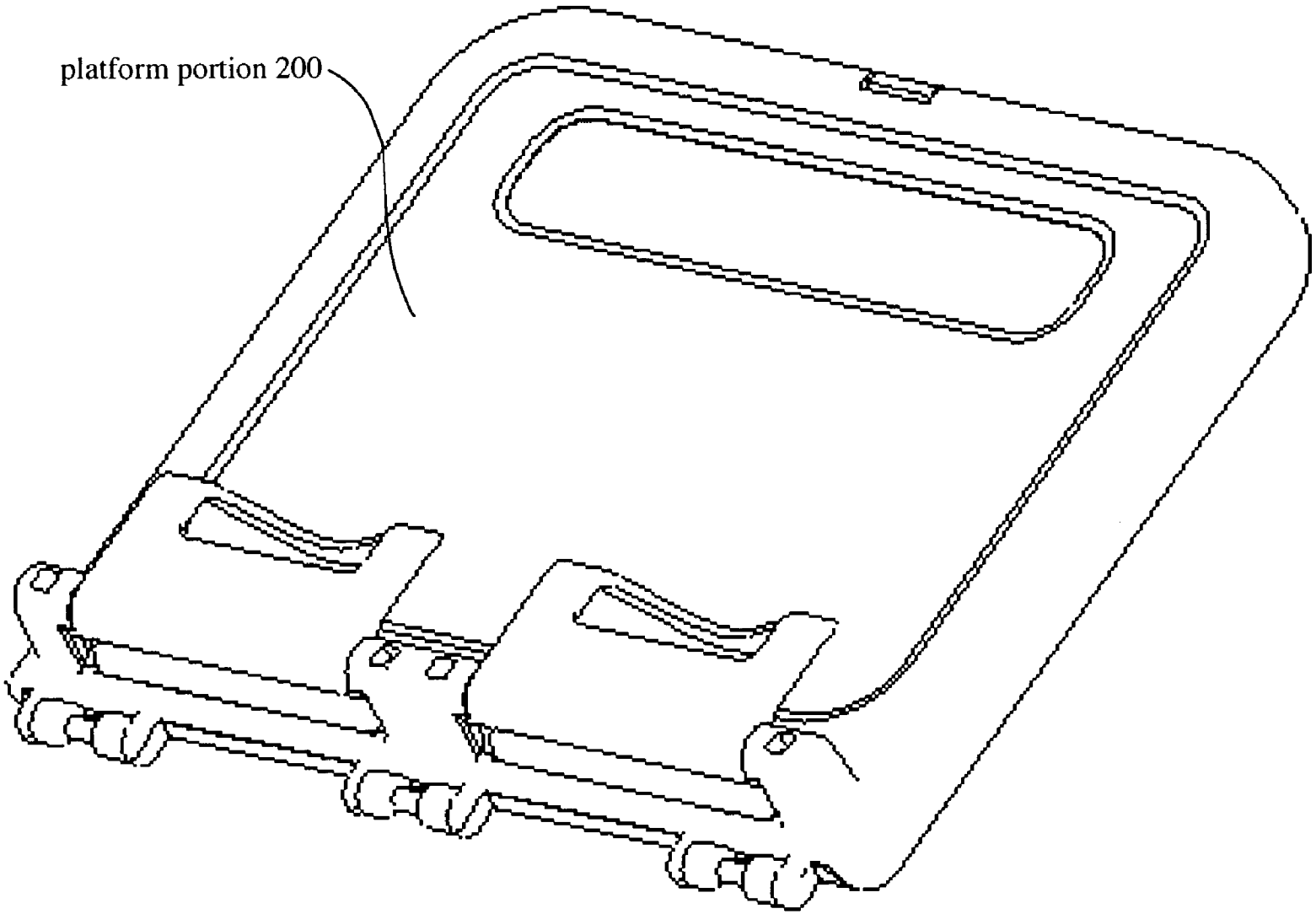
FIG. 8 is a view showing the platform portion without the base portion in accordance with one embodiment of the invention.

FIGS. 2 and 6 show molding apertures 206. As noted further below, molding of the base portion 100 or platform portion 200, for example, might be eased by the use of molding apertures. For example, the molding apertures 206 effectively provide a through opening, in conjunction with the receiving aperture 232, i.e., to allow easier molding of the platform portion 200.

In accordance with one embodiment of the invention, FIG. 4 and FIG. 10 shows bumper housings 190. A bumper housing 190 may be disposed on each side of the base portion 100 as shown. The bumper housing 190 serves to support the platform portion 200 vis-à-vis the base portion 100 and also provides structural strength to the document holder 10. For example, the bumper housings 190 may (in the closed position) bridge and support the page holder clearance openings 239 as shown in FIG. 9. The bumper housings 190 may avoid breakage of both the hinge assemblies 310, the page holders 220, as well as other portions of the document holder 10, especially during shipment or other transport.

The page holder 220 is described above. It is appreciated that any other known arrangement may be used to hingedly dispose the page holder 220 in the housings (230', 230, 240), i.e., such as the arrangement described in U.S. patent application Ser. No. 10/787,150, entitled READING STAND filed Feb. 27, 2004, which is incorporated herein by reference in its entirety. Further, it should be appreciated that any of the features described herein may be used in conjunction with the features described in the Ser. No. 10/787,150 application, and visa-a-versa.

As described herein, the devices above, in accordance with the various embodiments of the invention, have been described as a reading stand and described in the context of holding a book. However, it is appreciated that the devices of the invention may be used to hold a wide variety of materials for viewing, as may be desired. Accordingly, the devices of the invention might hold books, magazines, papers, photographs or any other object that might be physically supported on the device. Further, the term "book" as used herein is understood to mean any document with connected pages or portions, for example.

As described below, the document holder 10 may be constructed of any suitable material, such as for example plastic. Typically, the document holder 10 may be formed through a molding process. In conjunction with such molding, molding apertures may be used so as to allow easier molding processes to be used. For example, FIG. 6 shows molding apertures 206. Any suitable molding apertures may be used so as to ease the molding process.

The devices of the invention, in accordance with the various embodiments, may be made from any of a wide variety of materials, as is desired. The invention might be made of wood, plastic or metal, for example, or any other material. Further, a variety of production techniques may be used to make the reading stand as described herein. For example, suitable molding techniques might be utilized. Also, the various components of the reading stand may be integrally formed, as may be desired, in particular when using molding construction techniques. Also, the physical size of the respective arrangements may be adjusted to accommodate books of varying sizes.

In particular, the dimensions of the base apertures 170, as well as the document holder 10 in general may be varied. In accordance with one embodiment of the invention, each base aperture 170 may be slightly tapered. That is, as shown in FIG. 3, a width at the end of the base aperture 170 adjacent the hinge assembly 310 might be approximately 2 inches. A width at the opposing end of the base aperture 170 might be approximately 2.25 inches. Further, the length of each base aperture 170 might be approximately 5 inches. The width of the center rib 180 might be approximately 1 inch. Accordingly, such dimensions might be utilized to enhance the holdability of the document holder 10.

However, these dimensions might easily be varied based on the particular user targeted, the particular type of documents that the document holder 10 is designed to hold, the particular environment that the document holder 10 is designed for use in, as well as any other design criteria. For example, the dimensions described herein might be conducive to use of the document holder 10 on a plane or in other traveling environments. On the other hand, a document holder 10 that is designed for use in the home might be larger.

In conclusion, it will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

Accordingly, while the present invention has been described here in detail in relation to its exemplary embodiments, it is to be understood that this disclosure is only illustrative and exemplary of the present invention and is made to provide an enabling disclosure of the invention. Accordingly, the foregoing disclosure is not intended to be construed or to limit the present invention or otherwise to exclude any other such embodiments, adaptations, variations, modifications and equivalent arrangements.

What is claimed is:

1. A reading stand to support a document for reading by a user, the reading stand comprising:

a base portion including at least two apertures to allow the user to grasp the reading stand by extending the user's fingers through the apertures, the base portion also adapted to allow placement on a surface;

a platform portion for supporting the document, the platform portion being hingedly connected to the base portion; and the platform portion including at least one page holder for retaining the document upon the platform portion; and a prop member, the prop member extending from a backside of the platform portion, the prop member adapted to engage with the base portion so as to support the platform portion in an angled position;

the two apertures extend side by side and along a depth dimension of the base portion;

the two apertures extend along at least two thirds of the depth dimension of the base portion;

each aperture respectively occupies a substantial portion of half the base portion, with one of the apertures disposed on a right side of the reading stand, and one of the apertures disposed on a left side of the reading stand; and the base portion including two annular aperture flanges, each of the two apertures defined by and encircled by a respective one of the aperture flanges.

2. The reading stand of claim 1, wherein the base portion includes a base prop clip and the platform portion includes a plurality of platform prop clips, wherein in an open position: a first end of the prop being positioned in the base prop clip, and a second end of the prop being selectively positioned in one of the platform prop clips.

3. The reading stand of claim 2, wherein the second end of the prop may be moved from platform prop clip to platform prop clip so as to adjust the angle of the platform portion relative to the base portion.

4. The reading stand of claim 3, wherein the platform portion is hingedly connected to the base portion by a hinge assembly.

5. The reading stand of claim 4, further including a latch arrangement to secure the platform portion to the base portion in a closed position.

6. The reading stand of claim 4, wherein the at least one page holder is pivotally supported upon the platform portion.

7. The reading stand of claim 6, wherein the at least one page holder is spring loaded so as to bias the page holder against the platform portion.

8. The reading stand of claim 4, further including a bumper housing mounted on one of the base portion and platform portion adjacent, the bumper housing being elongated in shape and aligned with the hinge assembly, the bumper housing serving to provide support for the base portion vis-a-vis the platform portion when the reading stand is in a closed position, the closed position defining an interior volume, and the bumper housing disposed in such interior volume when the reading stand is closed.

9. The reading stand of claim 8, wherein the bumper housing is integrally formed with the base portion.

10. The reading stand of claim 2, wherein the prop member includes a platform connecting rib to connect to the platform prop clips and a base connecting rib to connect to the base prop clip.

11. A method of supporting a document for reading by a user using a reading stand, the method comprising:

providing a base portion including at least one aperture to allow the user to grasp the reading stand by extending the user's fingers through the apertures, the base portion also adapted to allow placement on a surface;

providing a platform portion for supporting the document, the platform portion being hingedly connected to the base portion, the platform portion including at least one page holder for retaining the document upon the platform portion; and providing a prop member, the prop member extending from a backside of the platform portion, the prop member adapted to engage with the base portion so as to support the platform portion in an angled position; a user placing a document on the platform portion; and the user grasping the base portion so as to support the reading stand; and the method further including providing two apertures in the base portion to assist the user in grasping the base portion; and wherein the base portion including two annular aperture flanges, each of the two apertures defined by and encircled by a respective one of the annular aperture flanges.

12. The method of claim 11, wherein each aperture respectively occupies a substantial portion of half the base portion; and wherein one of the apertures is disposed on a right side of the reading stand, and one of the apertures is disposed on a left side of the reading stand.

* * * * *